United States Patent [19]

Miller et al.

[11] 4,255,159

[45] Mar. 10, 1981

[54] POLYMER COMBINATIONS USEFUL IN FUEL OIL TO IMPROVE COLD FLOW PROPERTIES

[75] Inventors: Harold N. Miller, Millington; Max J. Wisotsky, Highland Park; Richard P. Rhodes, Westfield, all of N.J.

[73] Assignee: Exxon Research & Engineering Co., Florham Park, N.J.

[21] Appl. No.: 120,682

[22] Filed: Feb. 11, 1980

Related U.S. Application Data

[63] Continuation of Ser. No. 905,002, May 11, 1978, abandoned.

[51] Int. Cl.[3] ..... C10L 1/16; C10L 1/20

[52] U.S. Cl. ..... 44/62; 44/76; 44/79

[58] Field of Search ..... 44/62, 76, 79

[56] References Cited

U.S. PATENT DOCUMENTS

| | | | |
|---|---|---|---|
| 3,245,766 | 4/1966 | Lifson et al. | 44/62 |
| 3,442,790 | 5/1969 | Burlard et al. | 208/28 |
| 3,762,888 | 10/1973 | Kober et al. | 44/62 |
| 3,767,561 | 10/1973 | Rossi et al. | 208/37 |
| 3,926,579 | 12/1975 | Rossi et al. | 44/62 |
| 3,999,960 | 12/1976 | Langer, Jr. et al. | 44/62 |
| 4,019,878 | 4/1977 | Wisotsky | 44/62 |

*Primary Examiner*—Jacqueline V. Howard

*Attorney, Agent, or Firm*—Roland A. Dexter; Frank T. Johmann

[57] ABSTRACT

A polymeric substance, i.e. poly(isomerized $C_{12}$–$C_{50}$ monoolefin), alone or as the alkylation derivative of an aromatic compound in combination with a lubricating oil pour depressant having pendant alkyl groups of 6 to 32 carbon atoms are useful in improving the cold flow properties of distillate hydrocarbon oils.

6 Claims, No Drawings

POLYMER COMBINATIONS USEFUL IN FUEL OIL TO IMPROVE COLD FLOW PROPERTIES

This is a continuation of application Ser. No. 905,002, filed May 11, 1978 now abandoned

BACKGROUND OF THE INVENTION

1. Field of the Invention

The invention relates to an additive combination of a polymeric substance featuring poly (isomerized $C_{12}$–$C_{50}$ monoolefin) structure with a lubricating oil pour depressant having alkyl side chains of 6 to 32 carbon atoms as middle distillate fuel flow improvers.

2. Description of the Prior Art

Kerosene, which is a solvent for wax, has traditionally been a component of middle distillate fuel oils, e.g. diesel fuels, home heating oils, etc. With the demands for kerosene for use in jet fuels, the amount of kerosene used in distillate fuel oils have decreased over the years. This, in turn, has frequently required the addition of wax crystal modifiers, e.g. pour point depressant additives, to the fuel oil to make up the lack of kerosene. Included therein are lubricating oil pour point depressant additives, namely, alkylated aromatics, particularly wax-naphthalene, for middle distillate fuels (J.S. Pat. No. 3,245,766).

Other fuel oil pour depressants include: polymerization products of a mixture of normal $C_{10}$–$C_{26}$ alpha-olefins, said polymerization being carried out in the presence of a Friedel-Crafts catalyst as aluminum chloride (U.S. Pat. No. 3,252,771); and, copolymers of monoolefin mixtures, at least one of said monoolefins having an unbranched saturated hydrocarbon chain of at least 18 carbon atoms (British Pat. Spec. No. 1,154,966).

Other publications teach improving the cold flow properties of middle distillate fuels with various combinations, including: the combination of $C_{24}$–$C_{50}$ carbon content α-olefins, ethylene-vinyl acetate copolymers and beeswax (U.S. Pat. No. 4,019,878); the combination of an N-aliphatic hydrocarbyl carbyl succinamic acid or its derivative with a poly (α-olefin), with an α-olefin or with an alkylated aromatic compound, i.e. alkylated diphenyl (U.S. Pat. No. 4,014,663); and the combination of ethylene-vinyl acetate copolymer and copolymers of ethylene with $C_2$–$C_{18}$ α-olefins (U.S. Pat. No. 3,639,226).

SUMMARY OF THE INVENTION

It has been discovered that the combination of a polymeric substance featuring poly (isomerized monoolefins containing from 12 to 50 carbons) either as a polymer or a polymeric alkylation derivative of an aromatic compound and a polymeric lube oil pour point depressant having $C_6$ to $C_{32}$ pendant alkyl groups provide cold flow improvement of a middle distillate petroleum fuel oil boiling within the range of about 120° C. to about 450° C. at atmospheric pressure. In general, the (a) polymeric substance featuring poly (isomerized $C_{12}$–$C_{50}$ monoolefin) in combination with (b) lubricating oil pour depressants having straight chain alkyl groups of 6 to 32 carbon atoms as taught by this invention give synergistic results in controlling wax crystal size in said distillate fuel oils.

In general, the additive combination of the invention will comprise one part by weight of the substance featuring poly (isomerized $C_{12}$–$C_{50}$ monoolefin) per about 0.1 to 20, preferably 0.2 to 8 parts by weight of said second polymeric pour depressant. The distillate fuel oil compositions of the invention will contain a total of about 0.001 to 1.0, preferably 0.005 to 0.1 wt. % of said combination concentrate of 1 to 60 wt. % of said combination in 40 to 99 wt. % of mineral oil are useful for handling. The distillate fuel improved by the invention will have a viscosity in the range of 1.6 to 7.5 centistokes at 38° C. and will have less than 3 wt. %, usually less than 1 wt. %, of wax boiling above 350° C., i.e., wax having 20 more carbon atoms.

The Distillate Fuels

In general the distillate fuel oils of the invention will boil in the range of about 120° C. to 450° C. and will have cloud points usually from about −30° C. to about 5° C. The fuel oil can comprise straight run, or cracked gas oil, or a blend in any proportion of straight run and thermally and/or catalytically cracked distillates, etc. The most common petroleum middle distillate fuels are kerosene, diesel fuels, jet fuels and heating oils. The low temperature flow problem is most usually encountered with diesel fuels and with heating oils.

A typical heating oil distillate for which this invention is useful calls for a 10% distillation point of about 195° C., a 50% point of about 260° C., and a 90% point of about 350° C. and a final boiling point of about 380° C.

A diesel fuel distillate for which this invention is useful has a wax content of 6.9 wt. % at −29° C., a 90% distillation point (ASTMD-D-1160) between 320° C. and 340° C., a −6° C. cloud point and a final boiling point of about 345° C.

In measuring the boiling characteristics of these distillate fuels, ASTM-1160 distillation (a distillation under vacuum) can be used and the resulting boiling points are then corrected to boiling points at atmospheric pressure. Alternatively, ASTM Method D-86, which is an atmospheric distillation can be used, but usually some thermal cracking will occur so that the results of the D-86 distillation are less accurate.

Polymeric Substance Featuring Poly (isomerized $C_{12}$–$C_{50}$ Monoolefins As earlier indicated, one of the co-additives of the invention are the polymeriztion products and alkylation derivatives of normal alpha-olefins of 12 to 50 carbon atoms, preferably those n-α-olefins of about 16 to 32 carbons, optimally mixtures of α-olefins predominating in those having 20 to 30 carbons.

The normal $C_{12}$–$C_{50}$ olefins which are preferentially isomerized and concurrently polymerized can be represented by the formula $$R—C{=}CH_2$$

wherein the R groups are predominantly alkyl groups which contain 10 to 48 carbon atoms and thus include dodecene-1 through pentacontene-1, as exemplified by octacosene-1 and mixtures of any of the class.

The polymers of the invention can be polymerized with any conventional strong acid catalyst such as Lewis acids or protonic acids, such as aluminum chloride, $BF_3$, $FeCl_3$, $TiCl_4$, $H_2SO_4$, $HClO_4$. Any conventional co-catalyst may be used with the Lewis acids, e.g. water, protonic acids, alkyl halides, etc. Usually, the polymerization will be carried out in an inert diluent for the catalyst such as a hydrocarbon diluent, e.g. heptane, hexane, etc. or inert polar diluent such as methylene chloride, methyl chloride, nitromethane, nitrobenzene, mono- and polychlorobenzenes, etc., 0.2 to 20, preferably 1 to 10, mole % of the catalyst, based on the amount of olefin to be charged as olefin feed is added to the solvent, and the polymerization system is maintained about −50 to +100° C., preferably 0° to 50° C. in order to form the polymer.

After the polymerization has been effected, either by batch or continuous operation, the resulting polymer can be separated from residual catalyst as by washing with water, alcohol, dilute aqueous caustic soda or other suitable hydrolyzing and washing methods. The polymerization product is a light-colored, viscous oil having a number average molecular weight of about 400 to 3,000, preferably 800 to 2,000.

The acidic polymerization of the $C_{12}$–$C_{50}$ olefins is believed to produce a polymerization product of a mixture of isomers of the olefin charge resulting from the presence of the acid catalyst such as a Friedel-Crafts catalyst. This polymerization might be illustrated by the following reaction (assuming for purpose of illustration R is $C_{16}H_{34}$).

$$C_{16}H_{34}CH{=}CH_2 \xrightarrow{H^+} [C_8H_{17}CH^{\oplus}{=}CH{-}C_8H_{17} + C_9H_{19}CH^{\oplus}{=}CHC_7H_{15} + C_{10}H_{21}CH^{\oplus}{=}CHC_6H_{13} + C_{11}H_{23}CH^{\oplus}{=}CHC_5H_{11} + C_{12}H_{25}CH^{\oplus}{=}CHC_4H_9 + \text{etc.} + C_{16}H_{34}CH^{\oplus}{=}CH_2] \longrightarrow$$

poly[isomeric mixture of $C_{18}H_{37}$] of ($\overline{M}n$) of 400 to 3,000 with from 30 to 70, preferably 40 to 60, optimally about 50 molar percent of α-olefin. As aforementioned, the additive of the present invention is the polymerization of normal $C_{12}$ to $C_{50}$ alpha-olefin or mixtures thereof. Generally, it is preferred that the percentage of $C_{16}$ to $C_{32}$ alpha-olefin in a selected mixture be at least about 30% by weight, preferably at least about 60% and can constitute up to 99% or more by weight of the total mixed alpha olefin feed.

Once the poly(isomerized $C_{12-C50}$ olefin) is formed, it in turn can be used per se as the coadditive or its effectiveness can frequently be further improved by using the remaining unsaturation in the polymer to produce an alkylated aromatic derivative. The formation of said alkylated aromatic can be by general procedures well known in the art. The aromatics that are to be alkylated in accordance with this invention can have about 1 to 3 benzene rings, which in turn can have 0 to 3 alkyl groups per ring. Alkyl substituents may contain 1 to 20 carbon atoms. Other ring substituents may be present if they do no interfere. Examples of such aromatic materials include benzene, naphthalene, toluene, phenanthrene, xylene, butyl benzene, diphenyl, triphenylmethane, dimethylaniline, etc. Toluene is preferred.

Usually, the alkylation can be carried out by reacting 1:50 to 1:5, preferably 1:10 to 2:1, molar proportions of the olefin polymer, per molar proportion of the aromatic material, depending upon the number of alkyl groups desired. This reaction can be carried out in the presence of a Friedel-Crafts catalyst, normally using a solvent, by reacting the polymer e.g. a dimer and the aromatic material at a temperature of about 0° to 150° C. for about 0.1 to 10 preferably 0.2 to 4, hours.

The Friedel-Crafts catalysts will normally be used on the basis of about 0.001 to 0.1, preferably 0.01 to 0.05, molar proportions of catalyst per mole of the aromatic material. Examples of specific suitable catalysts include $AlCl_3$, $FeCl_3$, $AlBr_3$, $BF_3$, $SnCl_4$, $SbF_5$, etc., and strong protonic acids such as $H_2SO_4$, HF, etc.

The reaction will usually be carried out in the presence of an inert solvent, preferably a volatile solvent such as paraffins, isopraffins, naphthenes, methylene chloride, nitromethane, etc. When monoalkylation is desired, an excess of the aromatic compound is generally the preferred solvent. In some cases it is also possible to carry out the reaction in the absence of added solvent.

A convenient way of carrying out the alkylation is by dissolving the polymer in a solvent and continuously adding the solution of the polymer to the reaction vessel containing more solvent, the aromatic and the catalyst. Additional catalyst can be added during the course of the reaction, or periodically during the reaction, so as to keep the amounts of polyolefin reactant and catalysts roughly the same during the course of the reaction. The alkylation can be carried out so as to attach about 1 to 5 molar proportions, preferably 1 to 2 molar proportions, of the polymer per mole proportions of the aromatic material reacted.

Normally the amount of solvent will be about 0 to 95, preferably 50 to 90, parts by weight based upon 100 parts by weight of the aromatic material to be alkylated. Alternatively to using a volatile solvent, a mineral lubricating oil can be used, preferably one free of aromatic saturation, such as a white oil, so as not to interact with the reactants. When using an oil as solvent, the reaction product can be simply left in the oil to thereby form a concentrate for later use as an oil additive. However, if desired, the resulting product can be purified by distilling off the solvent, removing the catalyst by neutralization with caustic and then filtering. After the polymerization is completed the material can be purified by precipitation with alcohol, or other suitable non-solvents, and washing to remove catlyst residues. Hydrocarbon soluble polymers are also easily purified by washing a hydrocarbon solution thereof, with aqueous caustic, drying the solution and stripping the hydrocarbon solvent. Polymers prepared in the foregoing manner can have molecular weights ranging from about 400 to 3,000, usually about 700 to 2,000.

Lubricating Oil Pour Depressants

These pour depressants useful as a coadditive of the invention are generally polymeric materials having a known utility as a pour point depressant for lubricating oils. These depressants preferably are limited to the class consisting of: the alkyl aromatics, i.e. the condensation products of chlorinated waxes or olefins and aromatic or polynuclear aromatic (e.g. naphthalene) or aromatic hydroxyl compounds (e.g. phenols and naphthols); ester-base polymers including polyacrylates, polymethacrylates, copolymers of acrylates and methacrylates, fumarate/vinyl acetate copolymers, olefin-maleate and olefin acrylate or methacrylate copolymers; olefin copolymers; and sulfone copolymers of alpha-olefins and sulfur dioxide.

These preferable depressants highly useful as a coadditive of the invention are characterized by the structural presence of a linear hydrocarbon chain of about 10 to 30, preferably 18 to 24, carbons and have number average molecular weights ($\overline{M}n$) ranging from about 800 to 50,000.

Particularly preferred for use in this invention are the ester base polymers, polymers of $C_{12-C30}$ α-olefins, alkyl aromatics and sulfone copolymers.

A. Ester Base Polymers

These oil-soluble polymers will generally have (Mn), i.e. number average molecular weight, in the range of about 1000 to 50,000, preferably 1,000 to 30,000 as measured, for example, by Vapor Pressure Osmometry such as by a Mechrolab Vapor Pressure Osmometer. Usually at least about 25 wt. % of the polymer will be in the form of straight chain alkyl groups of a dicarboxylic acid ester, said alkyl groups having 6 to 30, e.g., 10 to 30 carbon atoms. These ester base polymers include polymers containing alkyl ester of an unsaturated $C_4$ to $C_8$ dicarboxylic acid, including copolymers with other esters or with olefins.

The dicarboxylic acid esters useful for preparing the second polymer can be represented by the general formula:

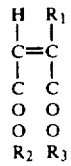

wherein $R_1$ is a hydrogen or a $C_1$ to $C_4$ alkyl group, e.g., methyl, $R_2$ is a $C_6$ to $C_{32}$ e.g., $C_{10}$ to $C_{30}$, straight chain alkyl group, and $R_3$ is hydrogen or $R_2$. Preferred examples of such esters include fumarate and maleate esters such as dilauryl fumarate, lauryl-hexadecyl fumarate, lauryl maleate, etc.

The dicarboxylic acid mono or di-ester monomers described above may be copolymerized with various amounts, e.g., 5 to 70 mole %, of other unsaturated esters or olefins. Such other esters include short chain alkyl esters having the formula:

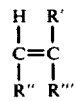

where R' is hydrogen or a $C_1$ to $C_4$ alkyl group, R'' is —COOR'''' or —OOCR'''' where R'''' is a $C_1$ to $C_5$ alkyl group, branched or unbranched, and R''' is R' or hydrogen. Examples of these short chain esters are methacrylates, acrylates, fumarates, maleates, vinylates, etc. More specific eamples include methyl acrylate, isopropyl acrylate, vinyl acetate, vinyl propionate, vinyl butyrate, methyl methacrylate, isopropenyl acetate, isobutyl acrylate, ect.

Examples of still other unsaturated esters, which can be copolymerized with the unsaturated dicarboxylic acid esters, are $C_6$ to $C_{18}$, e.g., $C_8$ to $C_{16}$, alkyl acrylates and methacrylates, e.g., n-octyl acrylate, n-decyl methacrylate, bexadecyl methacrylate, etc.

The ester polymers are generally prepared by polymerizing the ester monomers in a solution of a hydrocarbon solvent such as heptane, benzene, cyclohexane, or white oil, at a temperature generally in the range of from 15° C. to 125° C. and usually promoted with a peroxide type catalyst such as benzoyl peroxide, under a blanket of an inert gas such as nitrogen or carbon dioxide in order to exclude oxygen.

The unsaturated dicarboxylic acid mono or di-ester can also be copolymerized with an alpha-olefin. However, it is usually easier to polymerize the olefin with the dicarboxylic acid or its anhydride, and then esterify with 1 to 2 molar proportions of alcohol per mole of dicarboxylic acid or anhydride. To further illustrate, the ethylenically unsaturated dicarboxylic acid or anhydride or derivative thereof is reacted with a $C_8$ to $C_{34}$ olefin, by mixing the olefin and acid or anhydride, e.g., maleic anhydride, usually in about equimolar amounts, and heating to a temperature of at least 80° C., preferably at least 125° C. A free radical polymerization promotor such as t-butyl hydroperoxide or dit-butyl peroxide is normally used. The resulting copolymer thus prepared is then esterified with alcohol.

B. Olefin Polymers

Another useful class of lubricating oil pour depressants are olefin polymers, which can be either homopolymers of long chain $C_8$ to $C_{34}$, preferably $C_{12}$ to $C_{32}$ aliphatic alpha-monoolefins or copolymers of said long chain alpha monoolefins with shorter chain $C_3$-$C_7$ aliphatic alpha-olefins or with styrene or its derivatives, e.g., copolymers comprising 20 to 90 wt % of said $C_8$ to $C_{34}$ alpha-olefin and 10 to 80 wt. % of said $C_3$ to $C_7$aliphatic monoolefin, or styrene-type olefin whereby pendant groups of 6 to 32 carbons are present in substantial proportions.

Examples of such monomers include propylene, butene-1, hexene-1, octene-1, decene-1, 3-methyl decene-1, tetradecene-1, styrene and styrene derivatives such as p-methyl styrene, p-isopropyl styrene, alpha-methyl styrene, etc.

These olefin polymers may be conveniently prepared by polymerizing the monomers under relatively mild conditions of temperature and pressure in the presence of an organometallic catalyst, i.e., a mixture of a compound derived from a Group IV, V or VI metal of the Periodic Table in combination with an organometallic compound of a Group I, II or III metal of the Periodic Table, wherein the amount of the compoud derived from a Group IV-VI metal may range from 0.01 to 2.0 moles per mole of the organo metallic compound.

Effective catalysts for polymerizing the olefin monomers of the invention include the following combinations: aluminum triisobutyl and vanadium trichloride; a aluminum triisobutyl, aluminum chloride, and vanadium trichloride; vanadium tetrachloride trihexyl; vanadium trichloride and aluminum trihexyl; vanadium triacetylacetonate and aluminum diethyl chloride; titanium tetrachloride and aluminum trihexyl; vanadium trichloride and aluminum trihexyl; titanium trichloride and aluminum trihexyl; titanium dichloride and aluminum trihexyl, etc.

The polymerization is usually carried out by mixing the catalyst components in an inert diluent such as a hydrocarbon solvent, e.g. hexine, benzene, toluene, xylene, heptane, etc., and then adding the monomers into the catalyst mixture at atmospheric or superatmospheric pressures and temperatures within the ranges between about 10° and 80° C. Usually atmospheric pressure is employed when polymerizing monomers containing more than 4 carbon atoms in the molecule and elevated pressures are used if the more volatile $C_3$-$C_4$ alpha olefins are present. The time of reaction will depend upon, and is interrelated to, the temperature of the reaction, the choice of catalyst, and the pressure employed. In general, however, ½ to 5 hours will complete the reaction.

Usually, based upon 100 parts by weight of polymer to be produced, about 120 to 100,000 parts by weight of solvent, and about 0.05 and 5 parts by weight of catalyst will be used in the polymerization.

C. The Alkyl Aromatics

These materials are usually made by the Friedel-Crafts condensation of a halogenated paraffin or an olefin with an aromatic hydrocarbon. They are well known in the art, primarily as lube oil pour depressants and as dewaxing aids as previously mentioned. Usually, the halogenated paraffin will contain from about 15 to 50, e.g. 16 to about 40 carbons, and from about 5 to about 25 wt. %, e.g. 10 to 18 wt. % chlorine.

Typically, the halogenated paraffins are prepared by chlorinating to the above recited chlorine content a paraffin wax having a melting point within the range of about 38° to 94° C. The aromatic hydrocarbon used usually contains a maximum of three substituent groups and/or condensed rings. It may be a hydroxy compound such as phenol, cresol, xylenol or an amine such as aniline, but is preferably naphthalene, phenanthrene or anthracene. The alkyl aromatics preferably feature alkyl groups containing from 10 to 30 carbons and broadly have from 6 to 32 carbons.

D. Polysulfones

In general, the pilysulfones used in accordance with this invention have a number average molecular weight in the range of from about 1,000 to 50,000 or more, i.e. the upper range is limited only by the oil solubility of the polysulfone, and preferably comprises substantially equimolar amounts of a $C_{12}$–$C_{34}$ alpha-olefin and sulfur dioxide. Although in essence the polymer is an alterinating copolymer of said olefin and sulfur dioxide, it is understood that in some instances the respective molar amounts of the olefin and sulfur dioxide contained within the polymer may not necessarily be the same. For example, in the presence of a suitalbe polymerization catalyst such as those hereinafter described, it would be expected that some homopolymerization of the olefin would take place, thereby producing a polymer containing more than 50 mole percent of the olefin monomer. The present invention, therefore, contemplates the use of a sulfone copolymer comprising from about 50 to about 70 mole percent of an olefin and from about 30 to about 50 mole percent sulfur dioxide.

The $C_{12}$–$C_{34}$ alpha-olefins may be represented by the following general formula: $H_2C{=}CHR$ wherein R is a hydrocarbon radical containing a substantially linear alkyl group of at least 6 carbon atoms. In essence, it may be branched or unbranched and may contain cyclic structures but there should be a substantially linear alkyl side chain containing at least 6 carbon atoms, e.g., R may be a phenyl group containing a $C_6$–$C_{32}$ alkyl substituent. It is preferred, however, that R be a linear alkyl containing from about 10 to about 30 carbons atoms. Nonlimiting examples of suitably employed alpha-olefins include decene-1, dodecene-1, tetradecene-1, hexadecene-1, octadecene-1, eicosene-1, docosene-1, pentacosene-1, hexacosene-1, octocosene-1, triacotene-1, dotriacotene-1, tetracotene-1, $C_6$–$C_{32}$ alkyl styrene, $C_6$ to $C_{32}$ alkyl alpha methyl styrene, the like and mixtures thereof.

The olefin-sulfur dioxide polymers may contain a minor amount of a third type of monomer which is not an alpha-olefin within the carbon atom range recited above, e.g., a cyclic or acyclic olefin containing from about 2 to about 12, preferably 2-9, carbon atoms. In general, it is found that from 0 to about 40 wt. percent, e.g., 15 wt. percent, of the aforedescribed alpha-olefin may be replaced by the third type of monomer. Nonlimiting examples of these suitable monomers include ethylene, propylene, hexene-2, octene-1, norbornylene, cyclohexene, cyclooctene, cyclododecene, and the like.

Polymerization of the aforedescribed monomers may be effected by free radical catalysts, e.g. with those of the peroxide or azo-types, in a manner well known in the art.

The combinations of the invention may be used alone in the distillate fuel or in combination with still other oil additives, e.g., corrosion inhibitors; antioxidants; sludge inhibitors; etc.

The invention will be further understood by reference to the following examples which include preferred embodiments of the invention.

EXAMPLES

The following materials were used:

Polymeric Substance 1

Polymeric substance 1 resulted from the polymerizationof iosmerized alpha-olefins having an average carbon content of 28. The alpha-olefins resulted from a vacuum distillation cut of a composite of a series of ethylene polymerization runs, which composite had a boiling point such that the average molecular weight was equivalent to about a 28 carbon atom molecule. The polymer was prepared as follows: 50 grams of said average $C_{28}$ fraction was refluxed in 200 ml. of heptane with 0.1 grams of anhydrous $AlCl_3$. The reflux temperature of 98° C. was maintained for 3.1 hours. The solvent was then stripped from the reactants by distillation. The product was washed with $NaHCO_3$ and $H_2O$ to remove the catalyst residue and thereafter dried. The product was found to have a ($\overline{M}n$) of 1840.

Polymeric Substance 2

Polymeric Substance 2 was a poly (isomerized $C_{28}$ (ave.) alpha-olefin) alkylated toluene. The substances was prepared as follows: 50 grams of said average $C_{28}$ fraction was refluxed with 13.5 ml. of toluene and 1.0 gram anhydrous $AlCl_3$ in 200 ml. heptane for 3.1 hours at 100.2° C. The product was recovered and purified as the Substance 1. The product was found to have a ($\overline{M}n$) of 788.

Additive A

This was prepared as a concentrate of about 50 wt. % of a light mineral oil and about 50 wt. % of a wax-naphthalene made from 100 parts by weight of a n-paraffin wax (having a melting point of about 73° C. and chlorinated to about 12 wt. % chlorine) condensed with about 8.8 parts naphthalene by a Friedel-Crafts reaction.

Additive B

This was prepared as a concentrate of about 50 wt. % of a light mineral oil and about 50 wt. % of a sulfone copolymer of sulfur dioxide and a mixture of $C_{14\text{-}20}$ alpha-olefins with an olefin distribution of 0.58 mole % of $C_{14}$, 0.24 mole % $C_{16}$, 0.08 mole % of $C_{18}$ and 0.11 mole % of $C_{20}$.

Polymerization was carried out on an olefin charge of about 1.0 mole of said mixture dissolved in benzene with a slight positive pressure of $SO_2$ on the solution and by means of a free radical initiator (t-butyl hydroperoxide) introduced therein. About 2.8 moles of $SO_2$ was consumed during polymerization over a period of 65 minutes and at temperatures ranging from 10° C. to 24° C. The sulfone copolymer had an ($\overline{Mn}$) of 12,556 with an olefin distribution of 0.574 moles tetradecene-1, 0 239 moles hexadecene-1, 0.078 moles octadecene-1 and 0.109 moles of eicosene-1.

Additive C

This was an ethylene-vinyl acetate random copolymer having a number average molecular weight of about 1900 as determined by Vapor Pressure Osmometry (as were all measurements reported herein), having about 1.5 methyl terminated branches (exclusive of the methyl groups in the vinyl acetate) per 1,000 molecular weight of polymer and about 38 wt. % vinyl acetate. The copolymer was prepared by copolymerizing ethylene and vinyl acetate with dilauroyl peroxide at a temperature of about 105° C., under about 1050 psig ethylene pressure in cyclohexane solvent.

The Fuels

Properties of the Fuels tested are summarized in Table I which follows:

TABLE I

| Properties | Fuels I | Fuels II |
|---|---|---|
| Cloud Point, °C. | +1 | −1 |
| Aniline Point, °C. | 70.7 | 65.4 |
| Distillation °C. | D-86 | D-86 |
| IBP | 156 | 160 |
| 30% | 200 | 223 |
| 50% | 262 | 263 |
| 90% | 352 | 368 |
| F.B.P. | 355 | 388 |
| n-Paraffin range | $C_9$–$C_{30}$ | $C_{15}$–$C_{24}$ |

Fuel II represents a high end point middle distillate fuels of the invention, while Fuel I is a conventional middle distillate fuel. Fuels I and II each contained 0.5 wt. %, or less (based on the weight of the fuel) of n-paraffin wax boiling above 350° C.

Various blends of Polymers 1 and 2 with Additives A to C in Fuels I and II were made by simply dissolving the polymer or additive in the fuel oil. This was done while warming, e.g., heating the oil and polymer to about 200° F. if the polymer per se was added, and stirring. In other cases, the polymer was simply added with stirring to the fuel in the form of an oil concentrate which was usually about 50 wt. % polymer dissolved in a light mineral oil.

The blends were then tested for their cold flow properties in the test described below.

The Cold Filter Plugging Point Test (CFPPT)

The cold flow properties of the blend were determined by the Cold Filter Plugging Point Test (CFPPT). This test is carried out by the procedure described in detail in "Journal of the Institute of Petroleum", Volume 52, Number 510, June 1966, pp. 173–185. In brief, the Cold Filter Plugging Point Test is carried out with a 45 ml. sample of the oil to be tested which is cooled in a bath maintained at about −30° F. Every two degrees drop in temperature, starting from 4° F. above the cloud point, the oil is tested with a test device consisting of a pipette to whose lower end is attached an inverted funnel. Stretched across the mouth of the funnel is a 350 mesh screen having an area of about 0.45 square inch. A vacuum of about 7" of water is applied to the upper end of the pipette by means of a vacuum. Due to the vacuum, oil is drawn across the screen up into the pipette to a mark indicating 20 ml. of oil. The test is repeated with each two degrees drop in temperature until the oil fails to fill the pipette to the aforesaid mark due to clogging of the screen with wax crystals. The results of the test are reported as the temperature in ° C. at which the oil fail to fill the pipette in the prescribed time.

The blends prepared and the test results are summarized in Tables II and III which follow:

TABLE II

| Example No. | Effectiveness of Polymer/Additives in Fuel I: % Active Ingredient Polymer/Additive | CFPPT, °C. |
|---|---|---|
| II-1 | None | +1 |
| II-2 | 0.04% Polymeric Sub. 1 | 0 |
| II-3 | 0.04% Polymeric Sub. 2 | 0* |
| II-4 | 0.04% Additive A | −2 |
| II-5 | 0.04% Additive B | +2 |
| II-6 | 0.02% Polymeric Sub. 1<br>0.02% Additive A | −1 |
| II-7 | 0.02% Polymeric Sub 1<br>0.02% Additive B | −8 |
| II-8 | 0.02% Polymeric Sub. 2<br>0.02% Additive B | −6 |
| II-9 | 0.02% Polymeric Sub. 2<br>0.02% Additive A | −6 |

*unmeasured but believed from experience to provide substantially the same readings as II-2 and III-2 respectively.

TABLE III

| Example No. | Effectiveness of Polymer/Additives in Fuel II: % Active Ingredient Polymer/Additive | CFPPT, °C. |
|---|---|---|
| III-1 | None | −1 |
| III-2 | 0.02% Polymeric Sub. 1 | −9 |
| III-3 | Polymeric Sub. 2 | −9* |
| III-4 | 0.015% Additive A | −6 |
| III-5 | 0.02% Additive B | −1 |
| III-6 | 0.015% Additive C | −2 |
| III-7 | 0.02% Polymeric Sub. 1<br>0.02% Additive A | −13 |
| III-8 | 0.02% Polymeric Sub. 1<br>0.02% Additive B | −16 |
| III-9 | 0.01% Polymeric Sub. 1<br>0.01% Additive C | −16 |
| III-10 | 0.02% Polymeric Sub. 2<br>0.02% Additive B | −16 |

*see Table II

All percents are given in active ingredient.

Table II show synergy which obtains when the poly (isomerized $C_{12}$–$C_{50}$ monoolefin) additive is combined with a sulfone copolymer (compare II-7 with II-2 and II-5) or when the poly (isomerized $C_{12}$–$C_{50}$ monoolefin) substituted toluene additive is combined with a sulfone copolymer (compare II-8 with II-3 and II-5) or with an alkyl aromatic lube oil pour depressant (compare II-9 with II-3 and II-4).

Table III shows further synergistic examples according to the invention. When the poly (isomerized $C_{12}$–$C_{50}$ monoolefin) is combined any one of the preferred lube oil pour depressants synergy obtains (compare III-7, III-8 and III-9 with III-2 or III-4 or III-5 or III-6).

The invention is its broader aspect is not limited to the specific details shown and described and departures may be made from such details without departing from the principles of the invention and without sacrificing its chief advantages.

What is claimed is:

1. A fuel oil composition comprising a major proportion of a distillate petroleum fraction having an atmospheric boiling range of from about 120° C. to about 400° C. and from about 0.005 to 0.1 wt. % of a synergistic flow and filterability improving combination of the following:

(a) from 0.2 to 8 parts by weight of a polymeric substance selected from the group consisting of (i) poly (isomerized $C_{12}$–$C_{50}$ alpha monoolefin) wherein said monoolefin contains at least 60% by weight of $C_{16}$ to $C_{32}$ alpha monoolefin, said poly (isomerized $C_{12}$–$C_{50}$ alpha monoolefin) having a number average molecular weight of about 400 to 3000 and (ii) aromatics having 1 to 3 benzene rings alkylated with said poly (isomerized $C_{12\text{-}50}$ monoolefin); and (b) per part by weight of a lubricating oil pour depressant having a number average moleuclar weight of about 800 to 50,000 and having pendant alkyl groups of 6 to 32 carbons atoms, said pour depressant being selected from the group consisting of (i) the condensation product of chlorinated $C_{16\text{-}40}$ paraffin containing about 5 to 25 wt. % chlorine and an aromatic hydrocarbon, and (ii) a sulfone copolymer of sulfur dioxide and $C_{14\text{-}20}$ alpha olefin, wherein said synergistic combinations are combinations selected from the group consisting of (a) (i) with (b) (ii); (a) (ii) with (b) (i); and (a) (ii) with (b) (ii).

2. A fuel oil composition according to claim 1, wherein said lubricating oil pour depressant is said sulfone copolymer.

3. A fuel oil composition according to claim 1, wherein said polymeric substance is said poly (isomerized $C_{12}$–$C_{50}$ α-olefin.

4. A fuel oil composition according to claim 1, wherein said polymeric substance is said poly (isomerized $C_{12}$–$C_{50}$ α-olefin) alkylated aromatic compound.

5. A fuel oil composition according to claim 4, wherein said polymeric substance is a poly (isomerized $C_{28}$ (ave.) α-olefin mixture) alkylated toluene and said lubricating oil pour depressant is the condensation product of chlorinated wax and naphthalene.

6. A fuel oil composition according to claim 4, wherein said polymeric substance is a poly (isomerized $C_{28}$ (ave.) α-olefin mixture) alkylated toluene and said lubricating oil pour depressant is said sulfone copolymer.

* * * * *